United States Patent [19]

Terajima et al.

[11] Patent Number: 4,531,026

[45] Date of Patent: Jul. 23, 1985

[54] MULTIPLE SWITCH ASSEMBLY HAVING PULSATING SECONDARY CONTACTS

[75] Inventors: Jiro Terajima, Furukawa; Tadahiko Suzuki, Yokohama; Hisamichi Nagasawa, Tokyo, all of Japan

[73] Assignee: Sony Corporation, Japan

[21] Appl. No.: 476,228

[22] Filed: Mar. 17, 1983

[30] Foreign Application Priority Data

Mar. 19, 1982 [JP] Japan ..... 57-45172

[51] Int. Cl.[3] ..... H01H 9/20; H01H 13/56

[52] U.S. Cl. ..... 200/5 R; 200/16 B; 200/153 J; 200/160

[58] Field of Search ..... 200/5 R, 5 A, 5 B, 5 E, 200/16 B, 61.19, 153 J, 153 L, 153 LA, 153 M, 159 A, 160

[56] References Cited

U.S. PATENT DOCUMENTS

| | | | |
|---|---|---|---|
| 3,431,372 | 3/1969 | Obermann | 200/38 A |
| 3,751,618 | 8/1973 | Hallerberg | 200/159 R |
| 3,902,032 | 8/1975 | Koepke | 200/153 M |
| 4,096,368 | 6/1978 | Grebner | 200/16 B |
| 4,218,598 | 8/1980 | Iwasaki et al. | 200/153 J |
| 4,339,643 | 7/1982 | Murmann | 200/159 A |

*Primary Examiner*—J. R. Scott

*Attorney, Agent, or Firm*—Guy W. Shoup; Gerard F. Dunne

[57] ABSTRACT

A switch capable of individually switching two circuits through a double action of an actuator. The switch comprises: an actuator adapted to slide in a casing by a given stroke; a spring for energizing the actuator toward an initial position; a locking mechanism for preventing the actuator from returning toward the energizing direction by the spring at an intermediate position in the stroke; primary-side contacts adapted to be switched by means of the actuator in the course of movement thereof from the initial position to the intermediate position in the stroke; and secondary-side contacts adapted to be switched by means of the actuator in the course of movement thereof where the actuator further reciprocates against the spring from the locked state at the intermediate position.

9 Claims, 15 Drawing Figures

MULTIPLE SWITCH ASSEMBLY HAVING PULSATING SECONDARY CONTACTS

BACKGROUND OF THE INVENTION

1. Field of the Invention

The present invention relates to a double-action switch capable of individually switching two sets of contacts.

2. Description of the Prior Art

In switches having two circuits wherein a first circuit is actuated and then a second circuit is actuated while the first circuit is held in its actuated state, it is often necessary to provide two switches operated independently and connected to the respective circuits. When two switches are provided, there is a need for providing space on a chassis or the like for mounting the switches, which increases the overall size of the part containing the two switches. Moreover, there are possibilities that the operator may forget to turn OFF one of the switches in operation. Therefore, the operation of such switches of the prior art is complicated.

SUMMARY OF THE INVENTION

It is, therefore, an object of the present invention to provide a switch capable of individually switching two circuits through a double action of a single actuator, thereby overcoming the above-mentioned disadvantages of the prior art.

Other objects and advantages of the invention will be apparent from the following description taken in connection with the accompanying drawings.

BRIEF DESCRIPTION OF THE DRAWINGS

The following drawings illustrate preferred embodiments of the present invention, in which.

DESCRIPTION OF THE PREFERRED EMBODIMENTS

Preferred embodiments of the present invention will be described hereinunder with reference to the accompanying drawings.

Figure 1:
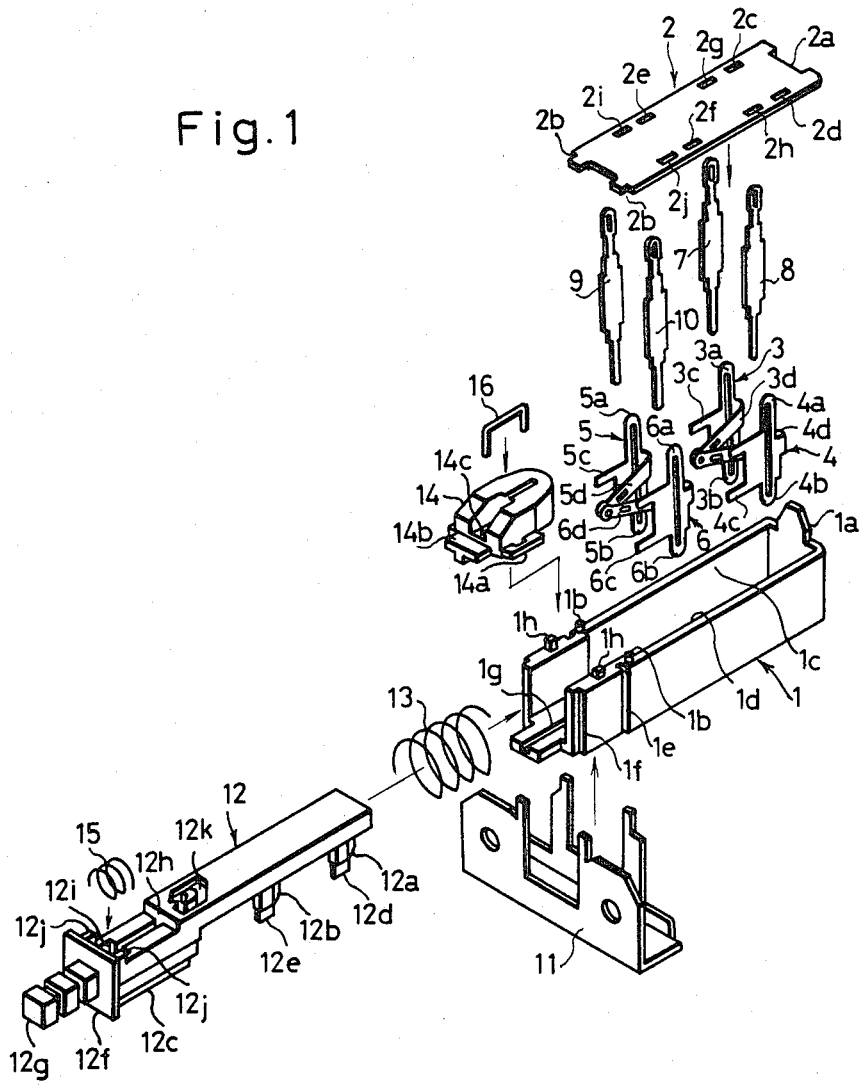
FIG. 1 is an exploded perspective view of a switch in accordance with a preferred embodiment of the present invention.
Figure 2A:
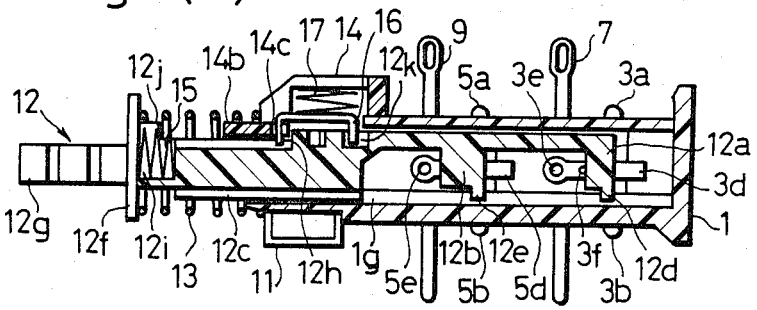
FIG. 2(A) is a longitudinal sectional view of the switch shown in FIG. 1 in the initial-position state.
Figure 2B:
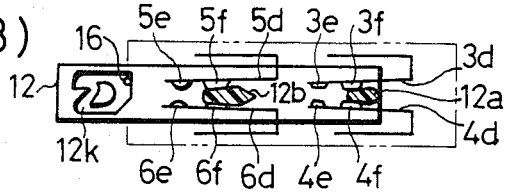
FIG. 2(B) a plan view of a part of the switch shown in FIG. 1 in the initial-position state, particularly illustrating the operation of the contacts thereof.
Figure 3A:
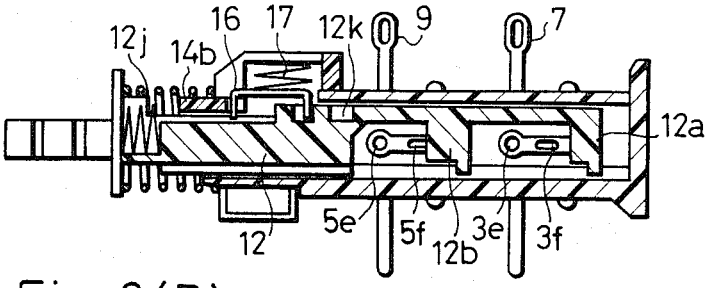
FIG. 3(A) is a longitudinal sectional view of the switch shown in FIG. 1 in the locked state.
Figure 3B:
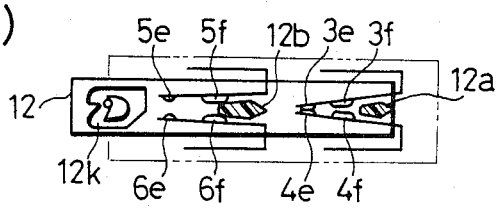
FIG. 3(B) is a plan view of a part of the switch shown in FIG. 1 in the locked state, particularly illustrating the operation of the contacts thereof.
Figure 4A:
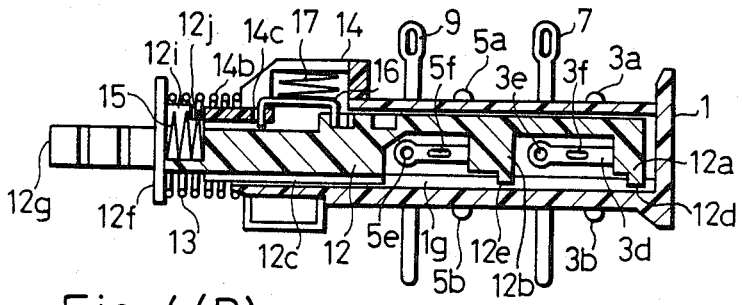
FIG. 4(A) is a longitudinal sectional view of the switch shown in FIG. 1 in the state where an actuator thereof is moved from the locked state.
Figure 4B:
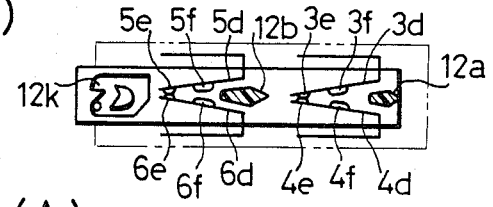
FIG. 4(B) is a plan view of a part of the switch shown in FIG. 1 in the state shown in FIG. 4(A), particularly illustrating the operation of the contacts thereof.

FIG. 1 is an exploded perspective view of a switch in accordance with a preferred embodiment of the present invention. FIGS. 2(A), 3(A) and 4(A) are sectional views of the switch, respectively, while FIGS. 2(B), 3(B) and 4(B) are plan views of a part of the switch, particularly illustrating the operation of the contacts thereof, respectively.

A casing 1 has at its upper end a projection 1*a* formed in the rear part and a pair of pins 1*b* formed in the front part. A cover 2 for covering the upper side of the casing 1 has a groove 2*a* formed at its rear end part and notches 2*b* formed at the sides of its front end. The cover 2 can be secured onto the casing 1 by allowing the groove 2*a* to engage with the projection 1*a* as well as the notches 2*b* to engage with the pins 1*b*. Contact plates 3 and 4 constituting primary-side contacts are mounted in the inner rear part of the casing 1, while contact plates 5 and 6 constituting secondary-side contacts are disposed in front of the contact plates 3 and 4. The contact plates 3, 4, 5, 6 have supporting pieces 3*a*, 4*a*, 5*a*, 6*a* formed at their respective upper ends. These supporting pieces are inserted in supporting slits 2*c*, 2*d*, 2*e*, 2*f* formed in the cover 2, respectively. Moreover, the contact plates 3, 4, 5, 6 have supporting pieces 3*b*, 4*b*, 5*b*, 6b formed at their respective lower ends. These supporting pieces are inserted in supporting slits (not shown) formed in the bottom part of the casing 1. The contact plates 3, 4, 5, 6 are secured inside the casing 1 through their respective supporting pieces thus supported. In addition, the contact plates 3, 4, 5, 6 are provided with pairs of upper and lower resiliently contacting pieces 3*c*, 4*c*, 5*c*, 6*c*. The resiliently contacting pieces 3*c* and 5*c* are adapted to resiliently contact one inner surface 1*c* of the casing 1, while the resiliently contacting pieces 4*c* and 6*c* are adapted to resiliently contact the other inner surface 1*d*. Furthermore, the contact plates 3, 4, 5, 6 have resiliently deformable arms 3*d*, 4*d*, 5*d*, 6*d* respectively. As shown in FIG. 4(B), a contact 3*e* formed at the end of the arm 3*d* and a contact 4*e* formed at the end of the arm 4*d* are adapted to resiliently contact each other (the primary-side contacts), while a contact 5*e* formed at the end of the arm 5*d* and a contact 6*e* formed at the end of the arm 6*d* are adapted to resiliently contact each other (the secondary-side contacts). Similarly, terminals 7, 8, 9, 10 are mounted inside the casing 1. The terminals 7, 8, 9, 10 have their respective upper ends projecting into supporting slits 2*g*, 2*h*, 2*i*, 2*j* formed in the cover 2 and their respective lower ends project into supporting slits (not shown) formed in the bottom plate of the casing 1, respectively. In addition, the central part of the terminal 7 is clamped between the resilient contacting piece 3*c* of the above-mentioned contact plate 3 and the inner surface 1*c* of the casing 1. Similarly, the terminal 8 is clamped between the resilient contacting piece 4*c* and the inner surface 1*d*, while the terminal 9 is clamped between the resilient contacting piece 5*c* and the inner surface 1*c*, and the terminal 10 is clamped between the resileint contacting piece 6*c* and the inner surface 1*d*. As a result, the terminal 7 and the contact plate 3 are adapted to conduct to each other. Similarly, the terminal 8 and the contact plate 4, the terminal 9 and the contact plate 5, as well as the terminal 10 and the contact plate 6 are adapted to conduct to each other, respectively. Moreover, the casing 1 has a pair of grooves 1*e*, 1*f* formed in its front outer surface. A fixing member 11 slidably fitted with the grooves 1*e* and 1*f* for fixing the switch main body to the chassis or the like.

An actuator 12 is mounted inside the casing 1. The actuator 12 has two actuating members 12*a*, 12*b* integrally formed at its lower part. Each of the actuating members 12*a*, 12*b* has a pentagonal section, as shown in FIG. 2(B). One actuating member 12*a* is adapted to be able to intervene between projections 3*f*, 4*f* formed on the arms 3*d*, 4*d* of the contact plates 3, 4, respectively, forming the primary-side contacts, through the operation of the actuator 12, while the other actuating member 12*b* is adapted to be able to intervene between projections 5*f*, 6*f* formed on the arms 5*d*, 6*d* of the contact plates 5, 6, respectively, forming the secondary-side contacts, through the operation of the actuator 12. Moreover, the actuator 12 has a rib 12*c* formed at its front lower end. Similarly, the actuating members 12*a*, 12*b* have ribs 12*d*, 12*e* formed at their lower ends. The ribs 12*c*, 12*d*, 12*e* are inserted in a guide groove 1*g* formed in the bottom plate of the casing 1, thereby allowing the actuator 12 to slide along the guide groove 1*g*. The actuator 12 has a supporting plate 12*f* integrally formed at its front part and moreover, a knob-fixing rod 12*g* is integrally formed at the end thereof. A spring 13 is compressed between the supporting plate 12*f* and the above-mentioned fixing member 11 so as to urge the actuator 12 away from the fixing member 11. A step 12*h* is formed in the front upper part of the actuator 12 and adapted to contact the inner surface of a cap 14 secured to the upper part of the casing 1 by means of the spring 13. FIG. 2(A) shows the state where the step 12*h* is brought into contact with the inner surface of the cap 14. This state is the initial-position state of the actuator 12. In addition, a groove 12*i* is formed in the rear upper surface of the supporting plate 12*f*, and an auxiliary spring 15 is inserted inside the groove 12*i*. Moreover, abutment steps 12*j* are formed at the upper positions on both sides of the groove 12*i*. Furthermore, a heart-shaped cam groove 12*k* is formed on the upper surface of the actuator 12. On the other hand, the above-mentioned cap 14 is secured by fitting fixing holes 14*a* formed in its sides with projections 1*h* formed on the casing 1. The cap 14 has a stopper 14*b* projecting from its front end. When the actuator 12 is pushed inside of the casing 1, the above-mentioned auxiliary spring 15 abuts against the stopper 14*b*, and when the actuator 12 is pushed in furthermore, the above-mentioned abutment steps 12*j* can abut against the stopper 14*b*. A U-shaped pin 16 and a spring 17 for pressing the pin 16 downwardly are mounted inside the cap 14. One of the bent portions of the pin 16 is supported by a supporting hole 14*c* bored in the front bottom part of the cap 14 so that the pin 16 can pivot horizontally, while the other bent portion is inserted in the heart-shaped cam groove 12*k* on the actuator 12.

Figure 5A:
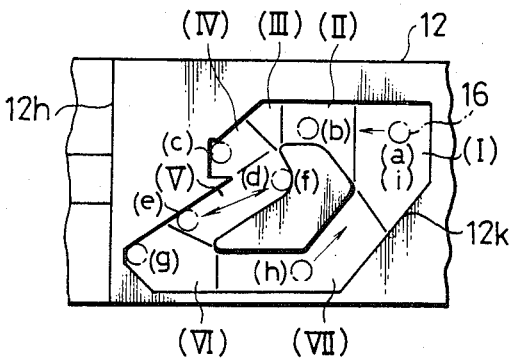
FIG. 5(A) is a plan view of a heart-shaped cam groove constituting a locking mechanism of the switch shown in FIG. 1.
Figure 5B:
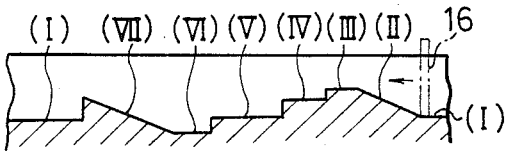
FIG. 5(B) is a developed sectional view showing the shape of the inside of the heart-shaped cam groove shown in FIG. 5(A)

FIG. 5(A) is an enlarged plan view of the heart-shaped cam groove 12*k* formed on the actuator 12. The heart-shaped cam groove 12*k* has seven cam positions, from (I) to (VII). The surfaces of the respective cam positions vary in contour and elevation as shown in FIG. 5(B) (a developed sectional view). The cam position (V) is formed into an extended groove longer than the corresponding cam groove of conventional cam grooves. The cam position (V) is for allowing the actuator 12 to reciprocate further inwardly in the casing 1 from the locked state.

The operation of the switch of the present invention arranged as described above will be described hereinunder.

Figure 6:
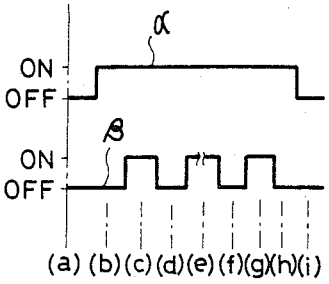
FIG. 6 is a diagram showing the operations of primary and secondary side contacts of the switch of the present invention.

The switch is arranged such that pushing the actuator 12 inwardly allows the primary-side contacts 3*e*, 4*e* and secondary-side contacts 5*e*, 6*e* to perform ON/OFF operations as shown in a diagram of FIG. 6. It is to be noted that, in FIG. 6, a line $\alpha$ indicates the operation of the primary-side contacts 3*e*, 4*e* while a $\beta$ indicates the operation of the secondary-side 5*e*, 6*e*. Moreover, ON denotes the state where the contacts are connected with each other, while OFF designates the state where the contacts are separate from each other.

FIGS. 2(A) and 2(B) show the state where the actuator 12 is projected outwardly by the force of the spring 13 and stopped by the contact of the step 12*h* of the actuator 12 with the inner surface of the cap 13, i.e., the initial state of the switch. Moreover, the end of the pin 16 is at the position (a) in the cam position (I) of the heart-shaped cam groove 12*k*. Under this initial state illustrated at (a) of FIG. 6, one actuating member 12*a* provided on the actuator 12 is between the projections 3*f* and 4*f* of the two contact plates 3, 4 forming the primary-side contacts, so that the contacts 3*e*, 4*e* are separate from each other, i.e., in a non-conducting state (OFF). Also, the other actuator 12*b* is between the projections 5*f* and 6*f* of the two contact plates 5, 6 forming the secondary-side contacts, so that the contacts 5*e*, 6*e* are separate from each other, i.e., in a non-conducting state (OFF).

As the actuator 12 is pressed inwardly against the spring 13, the end of the pin 16 moves from the cam position (I) to the cam positions (II) and (III) of the heart-shaped cam groove 12*k*. At an intermediate position (e.g., the position (b)), the actuating member 12*a* is first slipped out from between the projections 3*f*, 4*f*, causing the primary-side contacts 3*e*, 4*e* to be brought into the ON state. At this time, the actuating member 12*b* is still between the secondary-side projections of 5*f*, 6*f*, so that the contacts 5*e*, 6*e* are in the OFF state (see (b) in FIG. 6). As the actuator 12 is further pressed inwardly, the pin 16 reaches the position (c) in the cam position (IV). At this time, the actuating member 12*b* is also slipped out from between the projections 5*f*, 6*f*, causing the secondary-side contacts 5*e*, 6*e* to be also temporarily brought into the ON state (see (c) in FIG. 6). When the pressing force on the actuator 12 is removed at this position, the actuator 12 is returned towards its outer position by the force of the spring 13. Since a step is formed at the boundary between the cam positions (III) and (IV) of the heart-shaped cam groove 12*k*, the pin 16 urged downwardly by the spring 17 cannot climb over this step. Consequently, the return operation of the actuator 12 allows the pin 16 to reach the position (d) in the cam position (V) one step lower than the cam position (IV). When the pin 16 is at the position (d), the actuator 12 cannot return toward the cam position (IV), i.e., the actuator 12 is locked. This state is shown in FIGS. 3(A) and 3(*b*). Under this locked state, the actuating member 12*b* is between the projections 5*f*, 6*f* again, so that the secondary-side contacts 5*e*, 6*e* are in the OFF state. Also at this time, the primary-side contacts 3*e*, 4*e* are maintained in the ON state (see (d) in FIG. 6).

Next, when the actuator 12 is further pressed inwardly under the locked state, the pin 16 moves from the position (d) to the position (e) in the cam position (V). It is to be noted that since the cam position (V) is one step lower than the cam position (IV), there is no possibility that the pin 16 may return to the cam position (IV). The state where the pin 16 has reached the position (e) is shown in FIGS. 4(A) and 4(B). At this time, the actuating member 12*b* is slipped out from between the projections 5*f*, 6*f*, causing the secondary-side contacts 5*e*, 6*e* to be brought into the ON state. It is to be noted that, similarly to the case at the position (d), the primary-side contacts 3*e*, 4*e* are maintained in the ON state (see (e) in FIG. 6). In addition, when the pin 16 is at the position (e), the auxiliary spring 15 mounted on the front part of the actuator 12 is brought into contact with the front end of the stopper 14*b*, allowing the finger pressing the actuator 12 to feel a larger resistance. When the pressing force on the actuator 12 is removed at the position where the finger feels the resistance, the actuator 12 is urged outwardly by the force of the spring 13, and the pin 16 returns along the cam position (V) to the position (f), i.e., to the same lock position as the position (d). Thus, by pressing in the actuator 12 from the lock position to the postiion where the resistance force by means of the spring 15 increases and then resistance force by means of the spring 15 increases and then force, the pin 16 is reciprocated in the cam position (V) (the extended groove) in the course, (d)–(e)–(f). Repetition of this reciprocation (the state shown in FIG. 3(A) and that shown in FIG. 4(A) are alternately repeated) permits only the secondary-side contacts 5*e*, 6*e* to perform an ON/OFF operation (the line $\beta$ in FIG. 6) with the primary-side contacts 3*f*, 4*f* maintained in the ON state (the line $\alpha$ in FIG. 6).

The return operation for bringing each of the primary- and secondary-side contacts into the OFF state will be described hereinunder. As the actuator 12 is pressed in under the state where the pin 16 is at the position (d) or (f), when the pin 16 is at the position (e), the auxiliary spring 16 abuts against the stopper 14*b*, causing the resistance against the finger to increase (see FIG. 4(A)). When the actuator 12 is further pressed in against the resistance until the abutment step 12*j* of the actuator 12 is brought into contact with the stopper 14*b*, the pin 16 reaches the position (g) in the cam position (VI) one step lower than the cam position (V). At this time, both the primary-side contacts 3*e*, 4*e* and the secondary-side contacts 5*e*, 6*e* are in the ON state (see (g) in FIG. 6). When the pressing force on the actuator 12 is removed at that time, the actuator 12 is returned towards its initial outer position by the force of the spring 13. Since the cam position (VI) is one step lower than the cam position (V), the pin 16 will not return to the cam position (V) but reaches the position (i) in the initial cam position (I) through the cam positions (VI), (VII). Accordingly, the actuator 12 returns to the initial position shown in FIGS. 2(A) and 2(B). In the course of this return operation, the actuating member 12*b* first intervenes between the projections 5*f*, 6*f*, causing the secondary-side contacts 5*e*, 6*e* to be brought into the OFF state (see (h) in FIG. 6) and then, the actuating member 12*a* intervenes between the projections 3*f*, 4*f*, causing the primary-side contacts 3*e*, 4*e* to be also brought into the OFF state (see (i) in FIG. 6).

It is to be noted that although when the pin 16 is at the position (c), both the primary- and secondary-side contacts are once brought into the ON state in the above-described embodiment, it is also possible to move the actuator 12 to the lock position (d) while maintaining the secondary-side contacts 5*e*, 6*e* in the OFF state at the position (c), by changing the length of the cam position (IV) or the positional setting of the actuating members 12*a*, 12*b*.

Figure 7A:
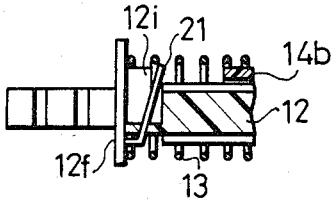
FIGS. 7(A) and 7(B) are sectional views of a part of a switch in accordance with another embodiment of the present invention based on the embodiment shown in FIG. 1 with a change in the structure of an auxiliary spring employed therein.
Figure 7B:
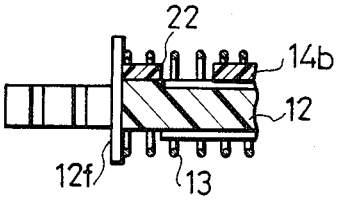

Another embodiment of the present invention is shown in FIGS. 7(A) and 7(B).

The switch shown in FIG. 7(A) has an auxiliary spring 21 mounted on the front part of the actuator 12, which auxiliary spring 21 is a plate spring (the spring 13 employed in the switch shown in FIG. 1 is a coiled spring). The auxiliary spring 21 may be made of metal or integrally formed with the actuator 12 by using the same resin as the material therefor. Moreover, the switch shown in FIG. 7(B) has a rubber bumper 22 secured to the frong part of the actuator 12 in place of the auxiliary spring.

The switch shown in FIGS. (A) and 8(B) is provided with as the primary-side contacts, contacts 31*a*, 32*a* formed on respective resilient arms 31, 32, similar to those shown in FIG. 1, and as the secondary-side contacts, contacts 33*a*, 34*a* are formed on a thin movable piece 33 and a thick movable piece 34 respectively. The primary-side contacts 31*a*, 32*a* are disposed at the front position in a casing 30, while the secondary-side contacts 33*a*, 34*a* are disposed at the rear position therein. An actuator 35 slidably provided in the casing 30 is energized in the projecting direction by means of a spring 36. The actuator 35 is provided with an actuating member 35*a* similar to that shown in FIG. 1 and an actuating member 35*b* projecting rearwardly. Moreover, a heart-shaped cam groove 35*c* completely identical to that shown in FIGS. 5(A) and 5(B) is formed on the upper surface of the actuator 35, and one end of a pin 38 disposed in a cap 37 provided on the upper part of the casing 30 is inserted in the heart-shaped cam groove 35*c*.

Figure 8A:
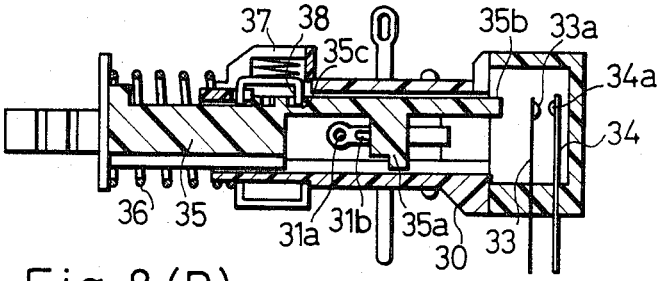
FIG. 8(A) is a longitudinal sectional view of the switch in accordance with still another embodiment of the present invention.
Figure 8B:
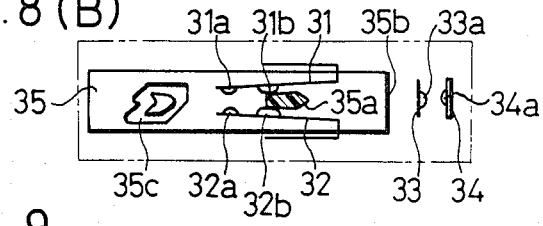
FIG. 8(B) is a plan view of a part of the switch shown in FIG. 8(A), particularly illustrating the operation of contacts thereof.

The operation of this switch will be described hereunder. Referring to FIGS. 8(A) and 8(B) showing the switch in the initial position, the actuating member 35*a* is between the projections 31*b* and 32*b*, so that the primary-side contacts 31*a*, 32*a* are in the OFF state. The rear actuating member 35*b* is also separate from the movable piece 33, so that the secondary-side contacts 33*a*, 34*a* are also in the OFF state. Under this state, the end of the pin 38 is at the position (a) (see FIG. 5(A)) in the cam position (I) of the heart grooved cam 35*c*. As the actuator 35 is pressed inwardly until the pin 38 reaches the position (d) in the cam position (V) through the cam positions (II), (III), (IV) and the actuator 35 is brought into a locked state where it is prevented from returning, the actuating member 35*a* is slipped out from between the projections 31*b*, 32*b*, causing the primary-side contacts 31*a*, 32*a* to resiliently contact each other, i.e., the primary-side contacts 31*a*, 32*a* are brought into the ON state. At this point of time, the actuating member 35*b* is separate from the movable piece 33, so that the secondary-side contacts 33*a*, 34*a* are still in the OFF state. When the actuator 35 is further pressed in from this lock position, the actuating member 35*b* presses the movable piece 33, causing the secondary-side contacts 33*a*, 34*a* to contact each other, i.e., the secondary-side contacts 33*a*, 34*a* are brought into the ON state. At the time when the actuating member 35*b* presses the movable piece 33 to resiliently contact the movable piece 34, the pin 38 reaches the position (e) (see FIG. 5(A)) in the cam position (V) of the heart-shaped cam groove 35*c*. Since the movable piece 34 is formed of a relatively thick plate material, there is an increase in the resistance against the finger pressing the actuator 35. When the pressing force on the actuator 35 is removed at the time when the resistance against the finger increases, the actuator 35 is returned by the spring 36, and the pin 38 returns from the position (e) to the position (f) in the cam position (V) (the extended groove), causing the actuator 35 to be brought into the locked state again. In other words, by repeating the process that the actuator 35 under the locked state is pressed inwardly until the movable piece 33 is brought into resilient contact with the movable piece 34 and the resistance against the finger increases, the secondary-side contacts 33*a*, 34*a* are allowed to perform an ON/OFF operation with the primary-side contacts 31*a*, 32*a* maintained in the ON state. Next, in the return operation for making both the primary and secondary sides OFF, the actuator 35 is pressed into a deeper position. When the actuating member 35*b* causes the movable piece 33 to resiliently contact the movable piece 34, the resistance against the finger increases. However, when the thick movable piece 34 is deflected, the pin 38 reaches the position (g) in the cam position (VI) of the heart groove cam 35*c* one step lower than the cam position (V). Then when the pressing force on the actuator 35 is removed, the actuator 35 is returned by the spring 36, and the pin 38 returns to the position (i) in the cam position (I) through the cam positions (VI), (VII), causing the actuator 35 to return to the initial position shown in FIGS. 8(A), 8(B).

Figure 9:
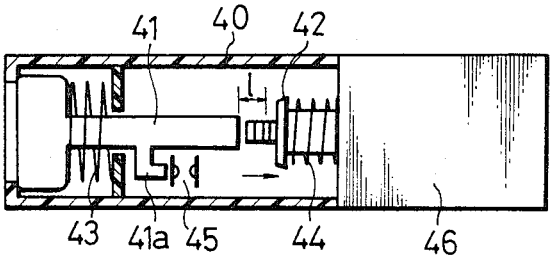
FIG. 9 is a partly-sectioned side elevational view of a switch in accordance with a further embodiment of the present invention.

In the embodiment shown in FIG. 9, two actuators 41 (a secondary-side actuator) and 42 (a primary-side actuator) are disposed in series in a casing 40. The secondary-side actuator 41 and the primary-side actuator 42 are urged in the leftward direction as viewed in the Figure (initial positions) by means of springs 43, 44 respectively. The secondary-side actuator 41 is provided with an arm 41*a*, which is adapted to actuate secondary-side leaf contacts 45. On the other hand, the primary-side actuator 42 is adapted to actuate a self-locking switch 46 disposed in the rear part of the casing 40. In the self-locking switch 46, primary-side contacts are provided.

FIG. 9 shows the switch in the initial position state. Under this state, both the actuators 41, 42 are projected leftwardly. The arm 41*a* of the actuator 41 is separate from the secondary-side contacts 45, so that they are in the OFF state. Moreover, the primary-side self-locking switch 46 is in the OFF state. When the secondary-side actuator 41 is pressed into the casing 40 under this state, the end of the actuator 41 presses the primary-side actuator 42. A given amount of pressure allows the actuator 42 to move in the direction (shown by an arrow) against the spring 44, and the actuator 42 is locked at that position. At this time, the contacts in the primary-side self-locking switch 46 are brought into the ON state. The actuator 42 stops at the lock position. On the other hand, the secondary-side actuator 41 is returned by the force of the spring 43, causing a gap l to be produced between this actuator 41 and the primary-side actuator 42. Thereafter, it is possible to bring the secondary-side contacts 45 into the ON state by pressing the secondary-side actuator 41 until it contacts the primary-side actuator 42. In other words, operating the secondary-side actuator 41 by a stroke l permits the secondary-side contacts 45 to perform an ON/OFF operation with the primary-side contacts in the self-locking switch 46 maintained in the ON state. Next, in order to bring the primary-side contacts into the OFF state, the actuator 41 is pressed further inwardly from the position where it is brought into contact with the actuator 42. As a result, the lock in the self-locking switch 46 is canceled. Both the actuators 41, 42 are returned to their respective initial positions shown in FIG. 9 by the forces of the springs 43, 44. Consequently, the primary-side contacts in the self-locking switch 46 are brought into the OFF state and at the same time, the secondary-side contacts 45 are also separated from each other, returning to the OFF state.

As will be fully understood from the foregoing description, according to the present invention, it becomes possible to repeat the switching operation of the secondary-side contacts with the primary-side contacts maintained in the switched state, since the actuator is locked at the intermediate position in the stroke as well as made capable of reciprocating within a given distance under the locked state so as to switch the primary-side contacts while moving from the initial position to the locked position as well as switch the secondary-side contacts by the reciprocating operation. Accordingly, a single switch can switch two or more circuits, so that it is possible to reduce the space for mounting switches. Moreover, since the primary and secondary side contacts can be simultaneously brought into the OFF state, there is no possibility that the operator may forget to turn OFF one of the switches, which often occurs in the case where two switches are provided.

Although the invention has been described through specific terms, it is to be noted here that the described embodiments are not exclusive and various changes and modification may be imparted thereto without departing from the scope of the invention which is limited solely by the appended claims.

What is claimed is:

1. A switch comprising: a casing, an actuator adapted to slide within said casing by a given stroke; a spring for urging said actuator toward an initial position outwardly of said casing; means including a locking mechanism for preventing said actuator from returning toward the initial position by said spring at an intermediate position in said stroke; means including primary-side contacts adapted to be switched by said actuator in the course of movement thereof from said initial position to said intermediate position in said stroke; and means including secondary-side contacts adapted to be switched repetitively by said actuator in the course of movement thereof when said actuator is repetitively reciprocated against the force of said spring from the locked state at said intermediate position.

2. A switch as defined in claim 1, wherein said locking mechanism comprises: a heart-shaped cam groove formed on said actuator; and a pin provided on said casing and adapted to move along said heart-shaped cam groove, said heart-shaped cam groove being provided with an extended groove for allowing said actuator to further reciprocate against said spring from said locked state in the course of said stroke.

3. A switch as defined in claim 1, wherein said actuator comprises: a primary-side actuator for switching primary-side contacts; and a secondary-side actuator that is a separate body from said primary-side actuator and adapted to switch said secondary-side contacts, said primary-and secondary-side actuators being energized toward their respective initial positions by means of springs respectively, said primary-side actuator being disposed in the rear of said secondary-side actuator in series, thereby locking only said primary-side actuator in the course of a stroke.

4. A switch as defined in claim 1, wherein said actuator has two actuating members, one of said two actuating members being adapted to be able to intervene between a pair of contact plates forming said primary-side contacts, while the other of said two actuating members being adapted to be able to intervene between a pair of contact plates forming said secondary-side contacts.

5. A switch comprising a first switch mechanism and a second switch mechanism held to a single casing, and means including a single actuator movable inwardly of said casing for actuating said first switch mechanism into a particular state thereof and thereafter repetitively acuating said second switch mechanism between two states thereof while maintaining said first switch mechanism in said particular state, said first switch mechanism including a pair of primary contacts resiliently urged towards contact with one another, and said second switch mechanism including a pair of secondary switch contacts resiliently urged into contact with one another, said primary switch contacts and said secondary switch contacts being aligned along the path of movement of said actuator, said actuator including means including a first actuation portion normally urging said primary contacts apart but allowing said primary contacts to engage one another when said actuator is moved to an intermediate position, means for holding said actuator within a limited range of movement including said intermediate position when said actuator is intitially moved into said intermediate position, said actuator having means including a second actuation position normally urging said secondary contacts apart but allowing said secondary contacts to engage one another as said actuator is moved past said intermediate position to enable said secondary contacts to be repetitively opened and closed as said actuator is reciprocated within said limited range of movement, and means for releasing said actuator from said limited range of movement upon forcibly urging said actuator therepast.

6. A switch according to claim 5, said holding means and said releasing means including a heart-shaped cam groove formed in said actuator.

7. A switch comprising a first switch mechanism and a second switch mechanism held to a single casing, and means including a single actuator movable inwardly of said casing for actuating said first switch mechanism into a particular state thereof and thereafter repetitively actuating said second switch mechanism between two states thereof while maintaining said first switch mechanism in said particular state, said first switch mechanism including a pair of primary contacts resiliently urged towards contact with one another, and said second switch mechanism including a pair of spaced contacts adapted to be urged resiliently into engagement by an end portion of said actuator, said actuator including means normally urging said primary contacts apart but allowing said primary contacts to engage one another when said actuator is moved to an intermediate position, means for holding said actuator within a limited range of movement including said intermediate position when said actuator is initially moved into said intermediate position wherein said end portion of said actuator can urge said secondary contacts into engagement as said actuator is moved past said intermediate position to enable said secondary contacts to be repetitively opened and closed as said actuator is reciprocated within said limited range of movement, and means for releasing said actuator from said limited range of movement upon forcibly urging said actuator therepast.

8. A switch according to claim 7, said holding means and said releasing means including a heart-shaped cam groove formed in said actuator.

9. A switch according to claim 7, including means resiliently urging said actuator into its normal position, and the resilient force necessary for bringing said secondary contacts into engagement being greater than the resilient force urging said actuator into said normal position.

* * * * *

UNITED STATES PATENT AND TRADEMARK OFFICE

CERTIFICATE OF CORRECTION

PATENT NO. : 4,531,026

DATED : July 23, 1985

INVENTOR(S) : Jiro Terajima, Tadahiko Suzuki, Hisamichi Nagasawa

It is certified that error appears in the above-identified patent and that said Letters Patent is hereby corrected as shown below:

Item [73] should read as follows:

"Assignees: Alps Electric Co., Ltd. and
Sony Corporation." (part interest)

Signed and Sealed this

Eighth Day of September, 1987

*Attest:*

DONALD J. QUIGG

*Attesting Officer*

*Commissioner of Patents and Trademarks*